US005170937A

United States Patent [19]

Vanotti

[11] Patent Number: 5,170,937

[45] Date of Patent: Dec. 15, 1992

[54] CONCRETE RAILROAD STRINGER OR TIE

[75] Inventor: Gérard Vanotti, Saint Paul de Varax, France

[73] Assignee: Etablissements Vape, Saint-Martin-du-Fresne, France

[21] Appl. No.: 709,650

[22] Filed: Jun. 3, 1991

Related U.S. Application Data

[62] Division of Ser. No. 442,580, Nov. 28, 1989, Pat. No. 5,042,717.

[30] Foreign Application Priority Data

Dec. 2, 1988 [FR] France ..... 88 15851
Oct. 10, 1989 [EP] European Pat. Off. ..... 89810764.4

[51] Int. Cl.[5] ..... E01B 9/30

[52] U.S. Cl. ..... 238/84; 238/345; 238/349

[58] Field of Search ..... 238/83, 84, 85, 90, 238/265, 310, 338, 349, 350, 355, 377, 378, 345

[56] References Cited

U.S. PATENT DOCUMENTS 776,450 11/1904 Andrew ..... 238/90
3,062,450 11/1962 Hanff ..... 238/85 X
3,326,466 6/1967 Sanson ..... 238/349
3,957,201 5/1976 Johnson et al. ..... 238/85 X
4,379,521 4/1983 Young et al. ..... 238/349
4,463,898 8/1984 Young et al. ..... 238/349
4,576,334 3/1986 Young ..... 238/310
4,588,126 5/1986 Foulart ..... 238/349 X
4,634,049 1/1987 Steinfeld et al. ..... 238/84
4,915,299 4/1990 Harkus ..... 238/349 X
4,934,594 6/1990 Harkus ..... 238/349 X

*Primary Examiner*—Michael S. Huppert
*Assistant Examiner*—James Eller
*Attorney, Agent, or Firm*—Kane, Dalsimer, Sullivan Kurucz, Levy, Eisele and Richard

[57] ABSTRACT

Concrete railroad stringer assembly for securing a railroad track comprising supports imbedded in the stringer and having a bow-shaped part extending above the stringer. The supports either are equipped with an abutment made of synthetic material or are made of ductile material forming itself an abutment for the railroad track. The supports are equipped with or intended to receive securing straps for securing the railroad track on the stringer.

3 Claims, 4 Drawing Sheets

CONCRETE RAILROAD STRINGER OR TIE

The present patent application is a divisional application of the parent application Ser. No. 442,580 filed Nov. 28, 1989, now U.S. Pat. No. 5,042,717.

FIELD OF THE INVENTION

The subject of the present invention is a concrete railroad stringer or tie equipped with abutment means for maintaining the rail laterally and possibly equipped with means for quick fastening the rail on the stringer.

PRIOR ART

As described, for example, in U.S. Pat. No. 4,927,078, the rail is maintained laterally on the stringer by two abutments of synthetic material lodged in recesses provided in the concrete and intended to receive fastening straps. However the manufacture of stringers or ties made of prestressed-concrete does not allow the presence of recesses.

The object of the invention is to provide a concrete stringer or tie with smooth surface equipped with abutment means or intended for receiving abutments on site and able to receive quick fastening straps.

SUMMARY OF THE INVENTION

According to a first aspect of the invention concrete railroad stringer or tie is equipped with bow-shaped metal supports equipped with abutments made of synthetic material or intended for receiving such abutments on site.

According to a second aspect of the invention a concrete railroad stringer or tie is equipped with abutments made of ductile material, anchored in the concrete and having a bow-shaped part located above the concrete and intended for the fastening of a strap.

The bow-shaped support or abutment can further receive a fastening strap such as described in U.S. Pat. No. 4,927,078 or in the parent application Ser. No. 442,580 without the necessity of providing a hole or similar in the concrete.

The bow-shaped supports or abutments may further be used as gripping means for handling the stringers or ties.

Embodiments of the stringer according to the invention will now be described with reference to the accompanying drawings.

DESCRIPTION OF THE PREFERRED EMBODIMENTS

Figure 1:
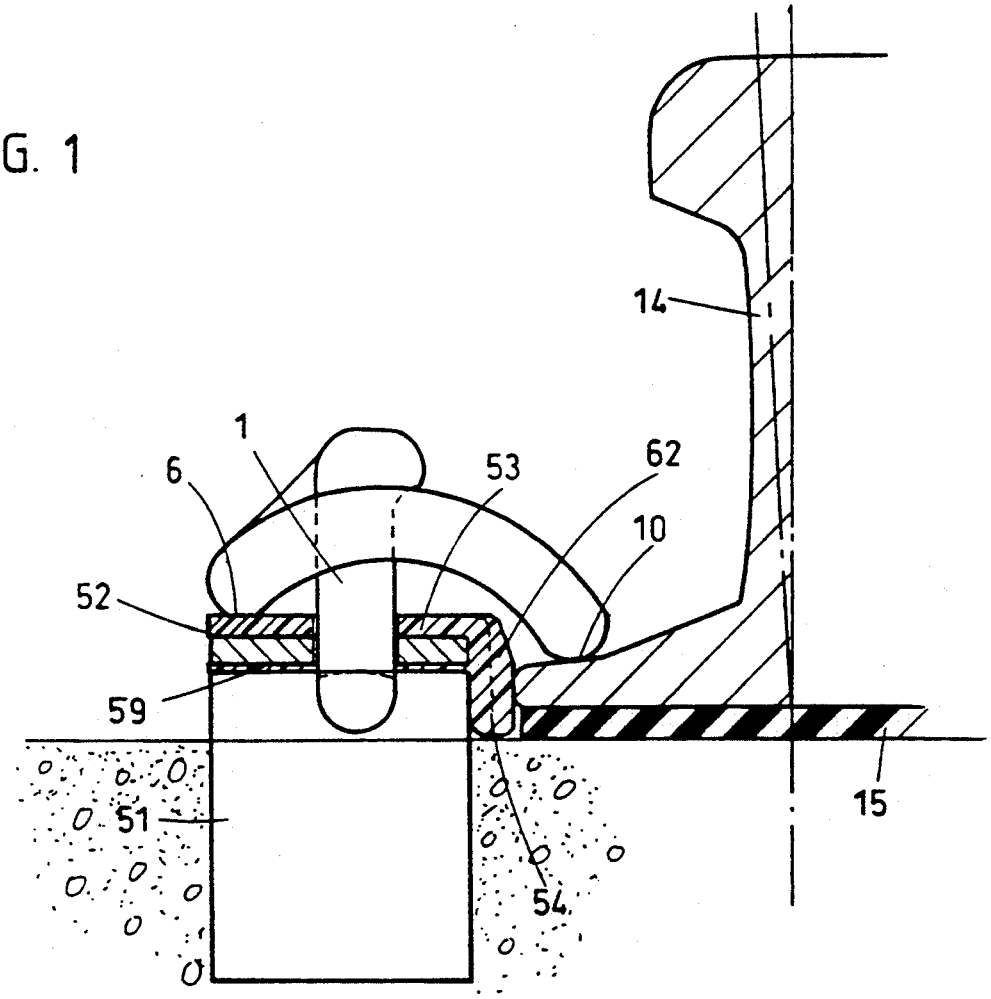
FIG. 1 is a partial view, in section according to I—I of FIG. 3, of a concrete stringer equipped with a fastening strap and with a rail, according to a first embodiment.
Figure 2:
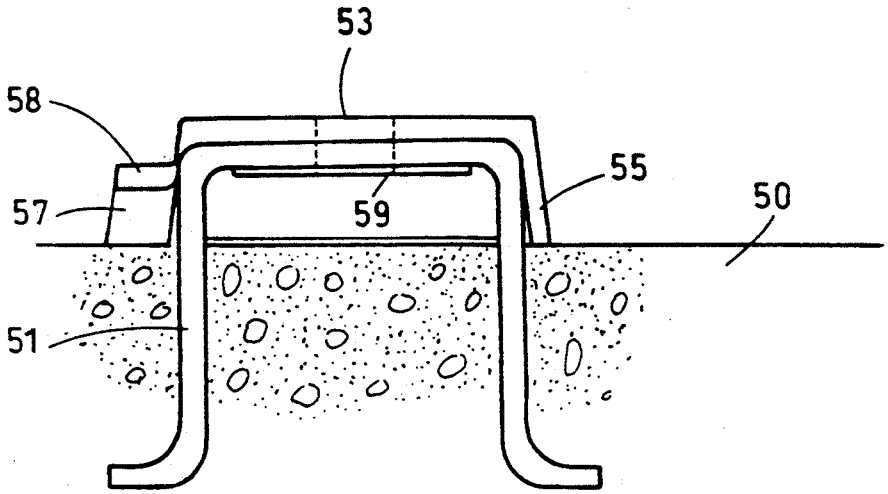
FIG. 2 is a side view in section according to II—II of FIG. 3.
Figure 3:
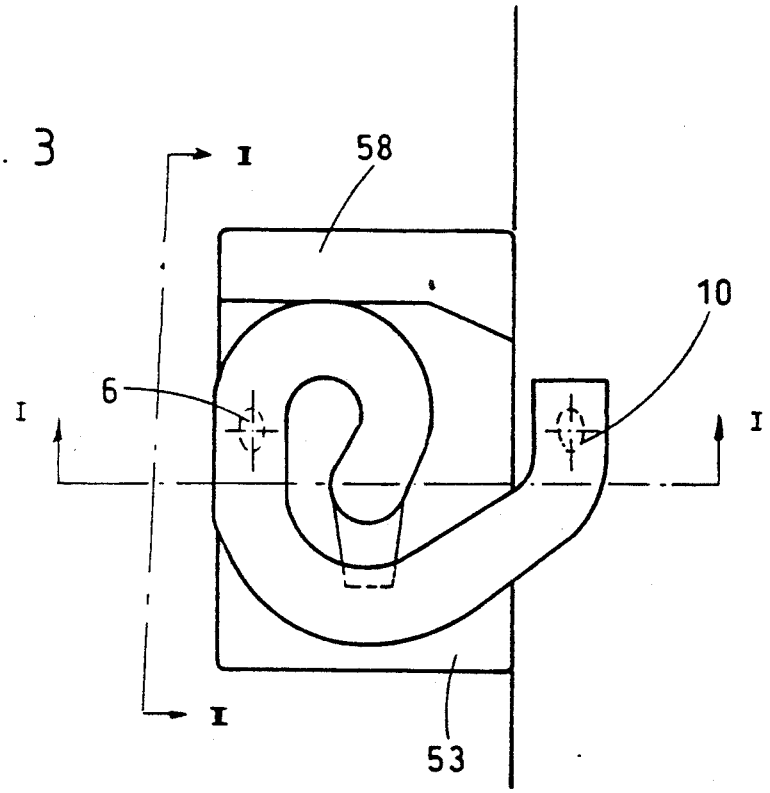
FIG. 3 is a plan view of the stringer of FIG. 1.
Figure 4:
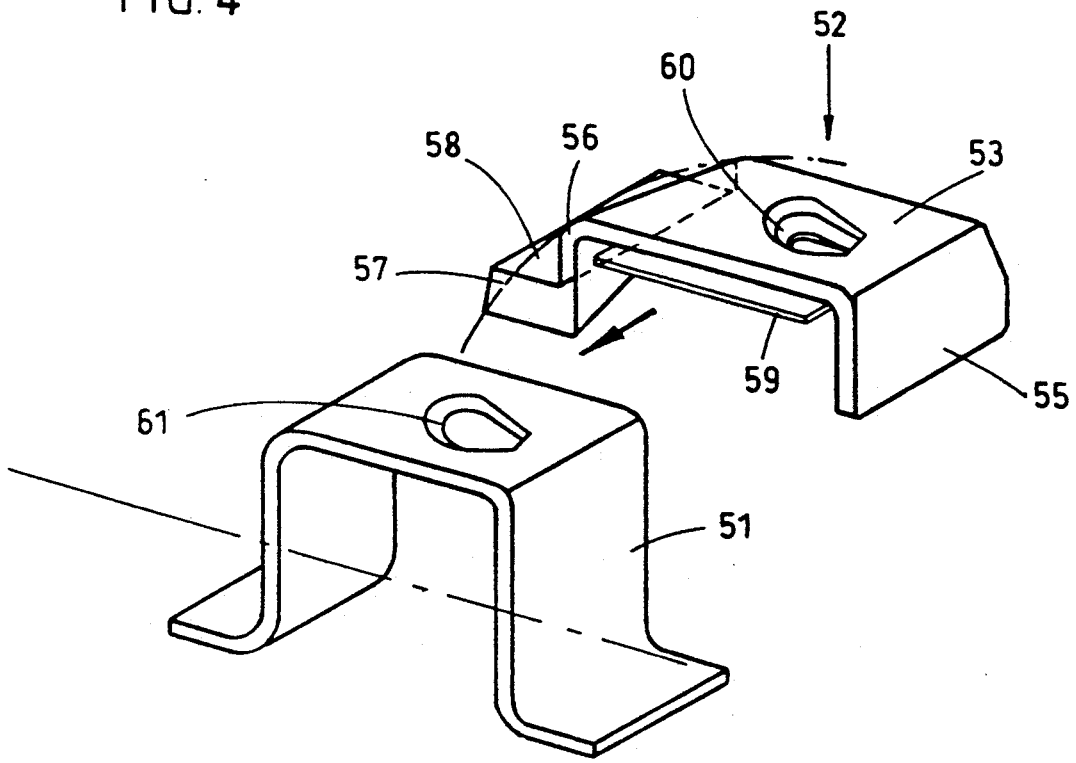
FIG. 4 is an exploded view of the metal support equipping the stringer of FIGS. 1 to 3 and of the abutment.

The FIGS. 1 to 4 show a prestressed-concrete stringer or tie 50, the surface of which is smooth. In this stringer are anchored metal supports 51 in the form of a bow with a rectangular profile, the lower ends of which are bent to ensure an anchorage in the concrete. An abutment 52 made of synthetic material is mounted on each of the supports 51. In parallel with the profile of the support 51, this abutment 52 likewise has a bow-shaped profile, as shown in FIG. 4. More specifically, the abutment has a plane upper face 53, a relatively thick side 54 serving as a centering abutment for the rail 14, and two thinner lateral sides 55 to 56 serving for retaining the abutment on the support 51, the side 56 being equipped with a heel 57, the upper face of which is in the form of a ramp 58 rising towards the part 54. A horizontal wall 59 starting from the part 54 extends between the walls 55 and 56. The distance between the wall 59 and the part 53 of the abutment corresponds to the thickness of the bar forming the support 51. The abutment 52 is slipped laterally onto the support 51 in the direction of the arrow of FIG. 4, the bow engaging between the part 53 and the wall 59 and between the walls 55 and 56. The abutment 52 is provided with a profiled hole 60 coinciding with a hole 61 of the same profile in the support 51, for the passage of a strap such as described in the parent U.S. Pat. No. 5,042,717. The upper portion of the part 54 of the abutment has a chamfer 62. When the abutment 52 is mounted on its support 51, the sides 55 and 56 and the heel 57 are in contact with the stringer 50. The abutment 52 is first equipped with the strap 1. The main bearing point 10 of the strap 1 is brought onto the start of the ramp 58 in order to fasten the strap temporarily. After the rail 14 has been installed between these abutments, this being made easier by the chamfers 62, the strap 1 is driven in rotation in such a way that the main bearing point 10 rises on the ramp 58 to the height of the flange and the rail 14. The perimeter of the upper face 53 of the abutment is contained between the circle of revolution of the intermediate bearing point 6 and the circle of revolution of the main bearing point 10.

By providing abutments having different thicknesses in the region of the part 54, it is possible, if the appropriate thickness is selected, to wedge the rail perfectly in the lateral direction.

Moreover, the thin wall 59 has the effect of insulating the strap electrically from the metal support 51.

Figure 5:
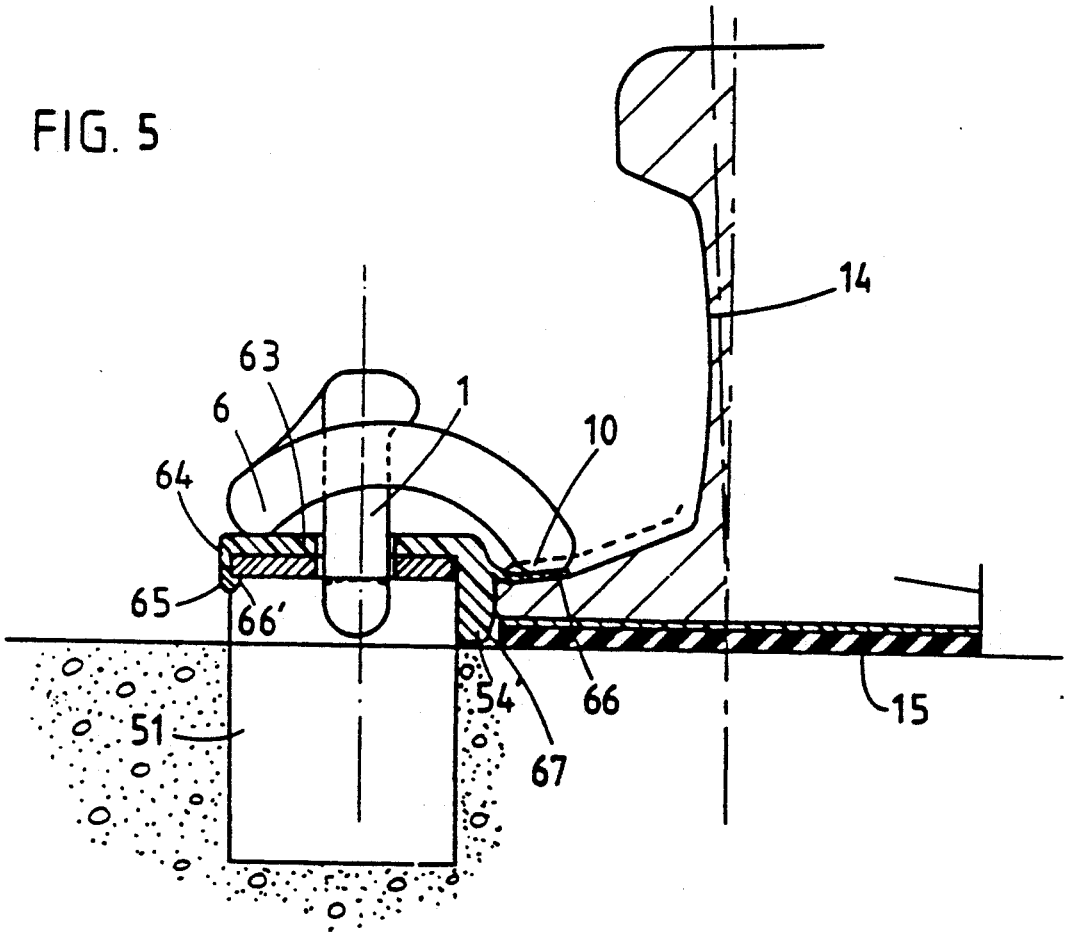
FIG. 5 shows the same stringer equipped with an abutment of a different form.

The abutment described above need not necessarily be mounted upon its metal support 51 before the laying of the rail. FIG. 5 illustrates an alternative embodiment allowing the insulating abutment to be fastened after the laying of the rail. Since the abutment is subject to wear, its replacement can thus be carried out without moving the rail. The abutment 63 differs from the abutment 52 in that the wall 59 is replaced by a rim 64 parallel to the part 54' corresponding to the part 54, this rim 64 terminating in a hook-shaped portion of expanded thickness 65 having a chamfer 66. The wall 64 is not connected to the side walls corresponding to the walls 55 and 56 of FIG. 4. The abutment 63 is installed vertically on the metal support 51, by pressure the abutment thereby elastically moving apart wall 64 which is snap fastened to the support 51.

The abutment 63 is advantageously equipped with a flexible tongue 66' extending laterally from the part 54'. As shown in the drawing, this tongue 66 is intended to rest on the flange of the rail 14. It is attached to the abutment somewhat high up, in such a way that it can follow the flange of the rail in its descending movement when it is being fastened by means of the strap 1. The tongue 66' is finally gripped between the flange of the rail and the main bearing point 10 of the strap 1. The tongue 66' protects the flange of the rail against a wearing effect as a result of the friction of the strap 1 and insulates the metal strap electrically from the rail.

The part 54' of the abutment includes, in its lower part, a chamfer 67 intended to make it easier to introduce this part 54' between the support 51 and the flange of the rail.

Figure 6:
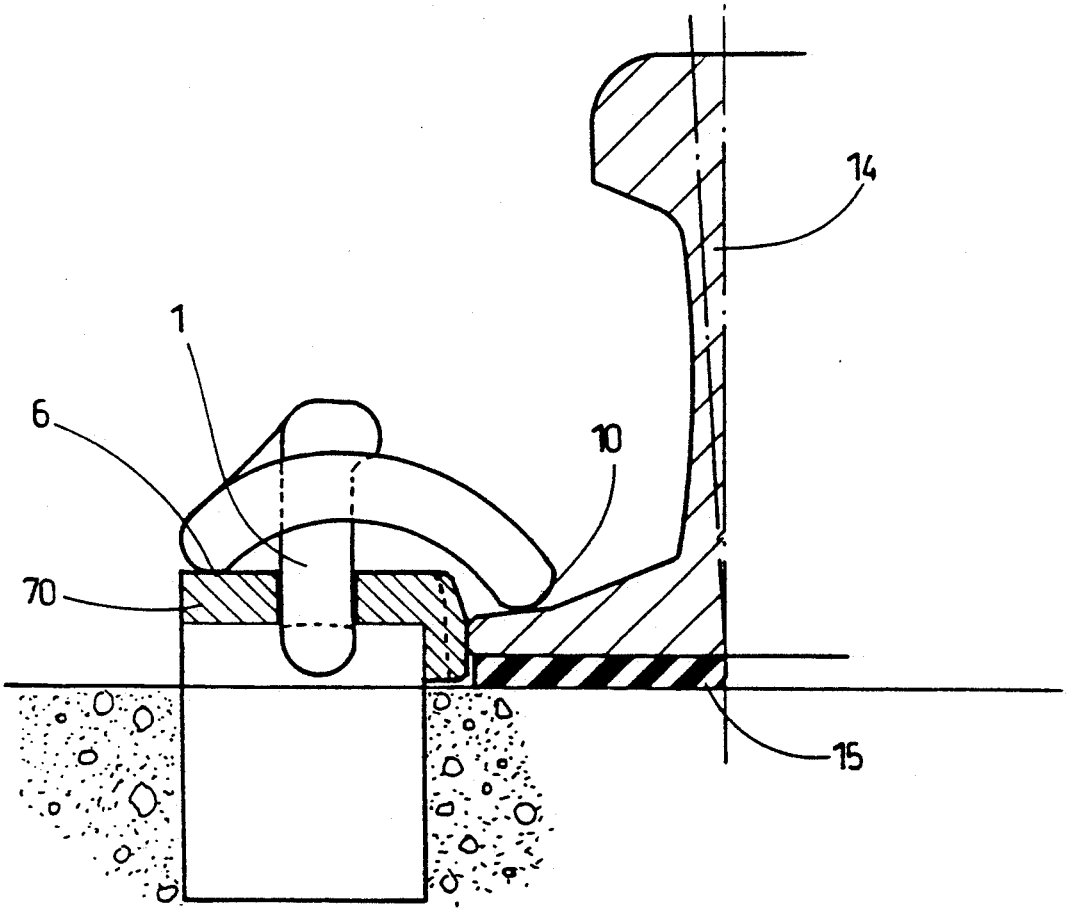
FIG. 6 shows a simplified embodiment.

In a simplified embodiment shown on FIG. 6, the support 51 and the abutment 52 of the first embodiment are in one piece 70 from a ductile material, such as cast iron, graphite cast iron, alloy or composite material. The abutment 70 so obtained takes the form of a piece anchored in the concrete and having a bow-shaped part located above the concrete and intended for the fastening of a strap 1.

I claim:

1. A concrete railroad stringer assembly for securing a railroad track comprising:

a concrete stringer with a top surface; metal supports imbedded in said stringer and including a vertical bow-shaped part, said bow-shaped part having a central portion and two depending leg portions at opposite ends thereof, said leg portions being embedded in said concrete stringer with said central portion extending above said top surface;

abutment means made of synthetic material mounted on said bow-shaped part of said supports; a railroad track securing strap including a vertical rectilinear part;

said central portion being provided with an aperture for mounting said vertical rectilinear part of said railroad track securing strap therethrough and ramp means on said abutment means for facilitating installation of and for tightening said railroad track securing strap against said metal supports.

2. A concrete railroad stringer assembly for securing a railroad track comprising;

a concrete stringer with a top surface; a railroad track securing strap including a vertical rectilinear part;

abutment means for said railroad track, said abutment means being made of ductile material imbedded in said stringer and including a vertical bow-shaped part, said bow-shaped part having a central portion and two depending leg portions at opposite ends thereof, said leg portions being embedded in said concrete stringer with said central portion extending above said top surface, an aperture in said central portion for mounting said vertical rectilinear part of said railroad track securing strap therethrough; and ramp means on said abutment means for facilitating installation of and for tightening said railroad track securing strap against said abutment means.

3. A concrete railroad stringer with a flat top surface comprising metal supports imbedded in said stringer and including a vertical bow-shaped part, said bow-shaped part having a central portion and two depending leg portions at opposite ends thereof, said leg portions being embedded in said concrete stringer with said central portion extending about said flat top surface; abutment means for said railroad track, and a railroad track securing strap including a vertical rectilinear part; said central portion having a rectangular cross-section for receiving said abutment means and an aperture for receiving said vertical rectilinear part of said securing strap therethrough; and ramp means on said abutment means for facilitating installation of and for tightening said railroad track securing strap against said metal supports.

* * * * *